United States Patent [19]

Cohen

[11] 3,983,012

[45] Sept. 28, 1976

[54] EPITAXIAL GROWTH OF SILICON OR GERMANIUM BY ELECTRODEPOSITION FROM MOLTEN SALTS

[75] Inventor: Uri Cohen, Stanford, Calif.

[73] Assignee: The Board of Trustees of Leland Stanford Junior University, Stanford, Calif.

[22] Filed: Oct. 8, 1975

[21] Appl. No.: 620,554

[52] U.S. Cl. ..... 204/15; 204/39; 204/60; 204/64 R; 204/71

[51] Int. Cl.[2] ..... C25B 1/00; C25D 3/66; C25D 5/02; C25C 3/00

[58] Field of Search ..... 204/39, 60, 64 R, 71, 204/15

[56] References Cited

UNITED STATES PATENTS

| | | | |
|---|---|---|---|
| 2,892,763 | 6/1959 | Stern et al. | 204/60 |
| 3,022,233 | 2/1962 | Olstowski | 204/60 |
| 3,219,561 | 11/1965 | Monnier et al. | 204/60 |
| 3,254,010 | 5/1966 | Monnier et al. | 204/64 R |
| R25,630 | 8/1964 | Cook | 204/39 |

OTHER PUBLICATIONS

J. J. Cuomo et al., J. Electrochemical Soc., p. 146c, June 1967.

*Primary Examiner*—G. L. Kaplan
*Attorney, Agent, or Firm*—Flehr, Hohbach, Test, Albritton & Herbert

[57] ABSTRACT

A method for electrodepositing an epitaxial crystal layer of germanium or silicon onto a single crystal substrate formed of germanium or silicon less noble than the layer. The substrate forms the cathode of an electrolytic cell containing a fused electrolytic salt bath which includes a salt source of plating ion (e.g., dipotassium silicon hexafluoride) and at least one alkali metal fluoride as the bath solvent. A vacuum is applied to remove gaseous impurities from the bath. Essentially all oxide is removed from the bath prior to electrolysis by reaction with a reagent (e.g., hydrogen fluoride) to form water vapor which is removed from the system by the vacuum. The bath may be doped with a different type or level of dopant than the substrate to form a junction.

14 Claims, No Drawings

EPITAXIAL GROWTH OF SILICON OR GERMANIUM BY ELECTRODEPOSITION FROM MOLTEN SALTS

BACKGROUND OF THE INVENTION

Epitaxial crystal growth means the deposition of a thin single-crystal film upon a substrate having a matching lattice structure. In the field of semiconductors, such crystal growth is performed most commonly on an oriented melt-grown single-crystal surface of the same material. Certain semiconductor devices, e.g., bipolar transistor ones, require epitaxial films in contrast to MOS transistor which do not require epitaxial films. Elemental germanium or silicon are grown in epitaxial films.

The conventional technique for growing epitaxial films is by chemical vapor deposition. Such processes are performed at relatively high operating tempertures, as on the order of 1200°C. At such temperatures, the epitaxial growth of the layer over an underlying p-n junction tends to blur or smear the dopants by cross-diffusion. Thus, it is difficult to fabricate sharp junctions in thin intermediate layers at such temperatures. Another problem with said vapor deposition techniques is that they employ hazardous gases such as corrosive silicon tetrachloride and highly inflammable and explosive hydrogen and silicon tetrahydride. Also, by such techniques, film thickness is limited to a minimum of about one micron.

Silicon has been electrodeposited onto metallic substrates to form a silicide coating onto the metal substrate comprising an alloy of silicon and metal. One such system is set forth in U.S. Re. Pat. No. 25,630. However, there is no suggestion that the technique of electrodepositing silicon from molten salts could be employed to form an epitaxial crystal layer onto a substrate.

SUMMARY OF THE INVENTION AND OBJECTS

In accordance with the invention, silicon or germanium are electrodeposited in an epitaxial layer onto a lattice matching structure which forms the cathode of an electrolytic cell. The cell includes a fused salt bath with a salt source of the plating ion (e.g., silicon) and an alkali metal fluoride solvent. When the current is passed through the bath, the silcon is deposited as an epitaxial layer onto the cathode surface.

An important feature of the invention is the removal of essentially all oxides from the electrolytic bath prior to electrolysis. This is accomplished by adding a reagent chemically reactive with the oxides to form a reaction product which is removed from the vicinity of the cathode in the bath. In a preferred method, the reactant is hydrogen fluoride and the reaction product, water, is vaporized and removed from the electrolyte by the application of a vacuum.

In another feature of the invention, the bath includes an n - or p - type dopant which is electroplated simultaneously with the crystal layer in proportions to form a desired n - or p - type layer. Also, for a relatively flat cathode substrate, a metal layer may be coated on one side to improve the uniformity of epitaxial crystal growth. The anode of the system either may be inert or may comprise a source of the plating ion. For particular application in the semiconductor industry, the epitaxial layer may be selectively electrodeposited in the window of an electrically nonconductive masking coating on the cathode substrate.

It is an object of the invention to provide a method for electroplating an epitaxial crystal layer of silicon or germanium from a molten salt bath.

It is a particular object of the invention to provide a system of the foregoing type performed at low enough temperatures to prevent cross-diffusion problems of underlying p-n junctions as in prior art processes.

It is a further object of the invention to provide a method of the foregoing type in which the epitaxial layer is uniformly deposited at a rate accurately controlled by electrical parameters while avoiding the hazards of dealing with the corrosive, inflammable and explosive gases employed in vapor deposition techniques.

It is another object of the invention to provide a method of the foregoing type in which epitaxial layers can be selectively grwon in islands which can be doped at a desired concentration for a particular semiconductor application.

It is another object of the invention to grow epitaxial films of submicron thickness which are useful in fast devices.

Further objects and features of the present invention will be apparent from the following description in which the preferred embodiments of the invention are set forth in detail.

DETAILED DESCRIPTION OF THE PREFERRED EMBODIMENTS

It has been discovered that the group IV*b* elements of silicon or germanium can be electrodeposited from a molten salt onto a lattice matching substrate of silicon or germanium so long as the substrate is at least as noble as the plating ion. Since germanium is more noble than silicon, the latter element may be electrodeposited onto a substrate of silicon (homoepitaxy) or germanium (heteroepitaxy). On the other hand, germanium may be electrodeposited onto a germanium substrate only. It is preferable to form a homoepitaxial layer since this facilitates the matching of the growing crystalline film with the underlying substrate.

For simplicity of description, the present application will refer to silicon as the plating ion and as the cathode substrate. However, it is also applicable to the plating of germanium with appropriate modifications of the substrate and plating salts.

The structure of the electrolytic cell of the present invention is of a conventional type. The cathode and anode are connected to a suitable source of an electrical current, preferably of a constant current type since current density controls the rate of deposition. The cathode of the system comprises a substrate of silicon which has been highly polished to provide a single crystal surface for epitaxial growth of silicon. In one embodiment, the anode comprises a metal substantially more noble than the silicon, e.g., gold. Alternatively, the anode may comprise a dissolving source of high grade silicon, e.g., a purity on the order of 99.999% or more.

The electrolytic bath comprises a salt source of plating ion (solute) and an electrolytic solvent for the salt source. Suitable solutes include alkali metal silicon fluoride, ammonium silicon fluoride, calcium silicon fluoride, barium silicon fluoride, and silicon tetrafluoride. The last-named solute may be supplied to the molten bath in gaseous form or may be present due to the decomposition of the other named solutes at elevated temperatures. Specific solutes include the sodium, lithium, potassium, and ammonium salts of silicon hexafluoride. Dipotassium silicon hexafluoride is a preferred salt because of its ready availability. For the electrodeposition of germanium, that element is substituted for silicon in the above salts.

A suitable solvent for the electrolytic salt bath is a conventional fused salt mixture comprising at least one alkali metal fluoride. As it is advantageous to carry out the process at the lowest temperature at which the bath remains molten, it is preferable to employ a eutectic mixture of solvents. A solvent which can be employed for the foregoing solute is a eutectic mixture of potassium fluoride and lithium fluoride in a 1:1 molar ratio, and melting point of 492°C. Another suitable solvent is a eutectic mixture of lithium fluoride, potassium fluoride, and sodium fluoride in a molar ratio of 46.5% to 11.5% to 42.8% at a melting point of 454°C. This composition is commonly referred to under the designation "Flinak".

The solute or source of plating ion is added to the solvent in the form of a preformed salt rather than adding the silicon in situ to the bath. For example, the dipotassium silicon hexafluoride salt is added directly to the solvent. In a less preferred embodiment, silicon tetrafluoride may be added as a gas to the molten salt electrolyte.

There is a minimum level of plating ion salt which must be present in the bath in order to deposit silicon as an epitaxial layer. Below this level, the silicon electrodeposits in a roughened state in polycrystalline form frequently including dendritic growth. It has been found that this problem may be avoided by using a minimum concentration of plating ion salt in the electrolytic bath on the order of 0.1 to 0.5 mole percent of solute.

The upper limit of solute concentration is determined by the melting point of the solution. That is, an increase in the solute concentration causes a corresponding increase in the melting point of the electrolytic bath. Since it is desirable to perform the electrodeposition at a relatively low temperature, the solute concentration is selected by balancing these factors. Suitable concentration of solute may be on the order of 1 to 5 mole percent to as high as 10 mole percent or more. At temperatures necessary to melt a bath containing concentration of solute above 10 mole percent, the partial pressure of silicon tetrafluoride is increased to a level at which significant loss occurs due to volatilization. At a concentration of 5 mole percent of dipotassium silicon hexafluoride the liquidus temperature occurs at a temperature of on the order of 665°C. However, it is preferable that the bath be maintained at a temperature on the order of 30° to 50°C higher than the liquidus temperature to prevent high viscosity and as a safety factor to avoid solids particles.

As mentioned above, the lower temperature limit is determined by the total melting point of the fused electrolytic salt bath which, in turn, is dependent upon the concentration of solute in the bath. A typical lower temperature limit for solute intermediate the 1 to 5 mole percent concentration is on the order of 650°C. For lower concentrations, temperatures as low as 600°C can be used. Above 5 mole percent concentration, the lower temperature limit is increased from 700°C to a higher level. The upper temperature limit is determined by a number of factors. As set forth above, it is desirable to operate at a relatively low temperature to avoid cross-diffusion in the substrate which might blur a p-n junction or other boundary in the substrate or between the substrate and deposited film. Additionally, as set forth above, at high concentrations, silicon tetrafluoride tends to volatilize excessively at temperatures exceeding 800°–850°C. This compound is either present as the solute or may be formed by decomposition of a solute salt. For example, dipotassium silicon hexafluoride is in equilibrium with potassium fluoride and silicon tetrafluoride. Accordingly, the preferable maximum temperature is on the order of 850°C.

The current density to be employed determines the desired rate of deposition of the epitaxial layer. A minimum density should be applied to avoid competition with adsorption of foreign substances on the exposed substrate surface. A suitable lower limit for this purpose is on the order of 1 to 2 milliamperes per square centimeter. At lower currents, undesirable hillocks or macrosteps may form. In addition, increasing current densities provide a higher rate of deposition. However, it has been found that if a maximum current density is exceeded, there is a tendency to deposit polycrystalline rather than expitaxial layers from the bath. For this purpose, the current density should be below 15 to 20 milliamperes per square centimeter. A preferable range of current densities is from 2 to 10 milliamperes, preferably on the order of 6 to 10 milliamperes per square centimeter.

It has been found that at the aforementioned current densities, a typical deposition rate for silicon is on the order of 1 to 10 microns per hour and more typically on the order of 6 microns per hour. As set forth above, if the rate of deposition is too fast, this can cause misorientation into a polycrystalline form of the deposited layer. Using this technique very thin (submicron) layers (e.g., 0.1 to 1 micron or less) may be epitaxially deposited. These are particularly useful in high frequency or fast devices.

The rate of deposition of plating ion is a function of current density. Accordingly, it is preferable to carry out the process at a constant predetermined current density as in the foregoing range. Suitable source of current are a potentiostat or a constant current power supply of a conventional type.

It is believed essential to the electrodeposition of epitaxial silicon in the above manner to remove impurities from the system prior to electroplating. In particular, it is believed to be necessary to remove essentially all oxides from the system prior to applying current. The presence of water vapor or other oxides in the system can cause a thin silicon oxide layer to form on the substrate which would prevent the plating silicon ions from depositing into the proper crystallographic sites for epitaxial growth. Any oxide ions present in the bath are reacted with a source of reagent chemically reactive with the same, and removed from the vicinity of the cathode.

In a specific technique for removing the oxides from the system, the source of oxide reactive reagent is hydrogen fluoride. Although this compound may be supplied separately to the bath, it is preferable to do so in salt form which decomposes at the melting temperature of the bath maintained during the oxide removal step. Thus, an alkali metal hydrogen difluoride may be supplied to the melt, e.g., potassium hydrogen difluoride. At the melting point of a typical bath, e.g., 700°C, this salt is decomposed into potassium fluoride and hydrogen fluoride. The hydrogen fluoride should be present in sufficient quantity to react with any oxide ion in the bath to form water vapor. Since this quantity is likely to be very small, as little as 1 to 10 mole percent of hydrogen fluoride or a source of the same provides a stoichiometric excess. If a eutectic mixture is to be maintained to accomplish the desired low melting point, appropriate modifications of the proportions of electrolyte may be made. For example, for each mole of potassium hydrogen difluoride employed as a reagent reactive with oxygen, the mole percent of potassium fluoride initially present is correspondingly reduced.

During the above reaction of oxides and hydrogen fluoride, the resulting water vapors are suitably drawn off together with other dissolved gaseous impurities such as oxygen and other sources of water vapor by the application of a vacuum. The gases withdrawn may be corrosive to the vacuum system. Accordingly, a vapor trap is disposed in the path intermediate the bath and vacuum source. A suitable trap includes a bath of coolant such as liquid nitrogen.

The removal of oxide impurities is preferably performed by reaction of the oxides to form a gaseous reaction product as set forth above. However, the oxide reaction product may also be separated from the melt if it forms a precipitate. For example, a material such as dipotassium zirconium hexafluoride, may be added to the melt and permitted to react with the oxide to form highly insoluble zirconium oxide which is precipitated away from the vicinity of the cathode.

After purification of the bath as set forth above, it may be cooled and transferred to a clean chamber and remelted. Prior to application of current, an inert gas such as helium is bubbled through the electrolytic bath to expel any further dissolved gases such as hydrogen fluoride. Then, a cathode and anode of the foregoing type are inserted into the molten bath together with a bubbler for inert gas such as helium. After lowering of the electrodes into the bath, an anodic short pulse may be applied to the substrate for etching the same. Then, a constant current is applied across the cell using conventional direct current source such as a potentiostat or constant current power supply. The inert gas atmosphere is maintained over the bath during electrolysis.

As set forth above it is important for epitaxial growth that the electrolytic bath be free of impurities except for known quantities of dopant. For this purpose, high purity salts and substrates should be employed. Impurities in the solution of metallic ions more noble than silicon may be removed by a pre-electrolytic process onto scrap substrates, e.g., molybdenum strips.

The silicon or germanium cathode is not characterized by exceptional electrical conductivity. Thus, there may be problems in forming a uniform epitaxial layer. It has been found that this problem can be overcome where the cathode is of an essentially flat configuration by coating on one side of a layer of metal, e.g., silver, significantly more conductive than silicon or germanium. Such material should also be more noble than the silicon or germanium. A relatively thin layer, e.g., 0.5 to 2 microns, has been found to be beneficial for this purpose.

The present process is particularly effective in the formation of integrated circuits in the semiconductor industry. For example, an appropriate dopant may be included in the electrolytic bath for codeposition at the desired concentration with the silicon or germanium. For example, if the cathode is of the p - type, the bath may include an n - type dopant in proportions to form a desired p-n junction. Suitable n - type dopants for this purpose include arsenic, antimony and phosphorous deposited from suitable salt sources in the electrolytic bath such as their respective alkali metal fluoride salts, e.g., potassium arsenic hexafluoride, potassium antimony hexafluoride and potassium phosphorous hexafluoride. Alternatively, where the cathode substrate is of an n - type, the bath may include a p - type dopant such as boron source including boron trifluoride or a fluoroborate, e.g., $KBF_4$. Another p - type dopant can be aluminum source such as aluminum trifluoride or fluoroaluminates, e.g., the alkali metal salts $K_3AlF_6$ or $KAlF_4$. Since both aluminum and boron are less noble than germanium or silicon, they may be used as major components (e.g., over 10 mole percent) of the bath depending upon the desired doping level.

An important advantage of all of the above doping processes is that at the relatively low temperature of electrodeposition, the dopant will not diffuse into the substrate to any significant extent and so sharp junctions are formed.

In another application, a p-n-p or n-p-n junction may be obtained by the epitaxial growth by electrodeposition on both sides of a relatively thin substrate (e.g., on the order of 10 to 100 microns). Such thin substrates may be formed by conventional techniques such as ribbon growth by the Dendritic Web technique or by the Edge Defined Film technique.

The above techniques may be employed for the fabrication of devices by the epitaxial electrodeposition through windows which are formed in an insulator layer, such as silicon nitride. It is important that the electrically insulative layer not be soluble in the electrolytic bath. Thus, although silicon dioxide is electrically insulative, it may not be employed for this purpose. This technique greatly simplifies the more complex processing required for integrated circuit formation by chemical vapor deposition techniques as set forth in Chapter 10-1 of a book by P. F. Kane and G. B. Larabee entitled "Characterization of Semiconductor Materials" (McGraw-Hill, 1970 edition).

In order to more clearly disclose the nature of the present invention, a specific example of the practice thereof is hereinafter given. It should be understood, however, that this is done by way of example and is intended to neither delineate the scope of the present invention nor limit the appended claims.

EXAMPLE

A molten bath is formed containing 5 mole percent dipotassium silicon hexafluoride solute dissolved in a solvent comprising a eutectic mixture of potassium fluoride and lithium fluoride with potassium hydrogen difluoride (10%) substituted for an equimolar portion of potassium fluoride.

The bath is purified prior to electrolysis as follows. The bath is melted at 750°C under a vacuum of less than 1 mm of Hg. At this temperature hydrogen fluoride is evolved which reacts with oxide impurities present to form water vapor which is drawn off by the vacuum together with other volatile gases. The water vapors are removed from the vacuum stream in a liquid nitrogen trap. Thereafter, the melt is purged for about one-half hour with helium to remove remaining hydrogen fluoride from the bath.

Then, the melted bath is cooled and transferred to a clean chamber and remelted by heating to a temperature of 750°C. A cathode comprising a scrap molybdenum strip and a 99.999% pure dissolving silicon anode are lowered into the melt and a current of 2 mA/cm² is applied for 12 hours to remove metal ions in the bath more noble than silicon in a pre-electrolysis step. Then, the molybdenum strip is removed and replaced with a cathode comprising a single crystal silicon substrate of (111) orientation with a mirror polished surface (2 square cm.) The spacing between the anode and cathode is about 2 cm.

Constant current is applied by a potentiostat to provide a current density of 6 mA/cm². In this configuration, the applied voltage is approximately 20–30mV. An epitaxial silicon layer plates onto the polished substrate at the rate of 6 microns/hour.

I claim:

1. A method for electrodepositing an epitaxial crystal layer of a group IV*b* element plating ion selected from the group consisting of silicon and germanium onto a lattice matching substrate selected from said group IV*b* elements at least as noble as said plating ion, said substrate comprising the cathode of an electrolytic cell, said method comprising:

a. forming an electrolytic salt bath for said electrolytic cell including a salt source of said plating ion and a solvent comprising at least one alkali metal fluoride, said salt source of plating ion comprising at least 0.1 mole percent of said bath composition, b. removing essentially all oxides from the electrolytic bath by the following steps:

1. applying a vacuum to the bath,
2. supplying in the bath a source of reagent chemically reactive with oxide ions in sufficient quantity to react with any oxide ion in the bath,
3. reacting said oxygen reactive reagent with oxygen in the bath at a molten bath temperature, and
4. removing the reaction product from the bath, and c. passing a current between an anode in the bath and said cathode at a sufficient current density to electrodeposit silicon as an epitaxial crystal layer onto said cathode, said bath being maintained under an inert gas atmosphere at a temperature sufficient for said bath to be in a totally molten state.

2. The method of claim 1 in which the temperature of said bath varies between 600°C and 850°.

3. The method of claim 1 in which said oxide reaction product is gaseous and is removed from said bath under said vacuum.

4. The method of claim 3 in which said oxygen reactive reagent is selected from the group consisting of hydrogen fluoride and a source of hydrogen fluoride.

5. The method of claim 1 in which said oxygen reactive reagent is hydrogen fluoride formed in situ in said bath by the decomposition of potassium hydrogen difluoride.

6. The method of claim 1 in which said plating ion is silicon and said salt source of plating ion is selected from the group consisting of alkali metal silicon fluoride, ammonium silicon fluoride, calcium silicon fluoride, barium silicon fluoride and silicon tetrafluoride.

7. The method of claim 1 in which said cathode is p-type and said bath includes n-type dopant which is electroplated simultaneously with said crystal layer in proportions to form a desired p-n junction.

8. The method of claim 1 in which said cathode is n-type and said bath includes p-type dopant which is electroplated simultaneously with said crystal layer in proportions to form a desired p-n junction.

9. The method of claim 1 in which said cathode substrate is essentially flat and includes on one side a metal layer significantly more conductive and noble than said cathode to improve the uniformity of epitaxial crystalline growth.

10. The method of claim 1 in which an electrically insulative layer including at least one open window is disposed on the surface of said cathode prior to contacting the same with said electrolytic bath, whereby said epitaxial crystal selectively grows only in the window.

11. The method of claim 1 in which the plating ion and cathode substrate are silicon.

12. The method of claim 1 in which said plating ion and anode are silicon.

13. The method of claim 1 in which the current density varies in the range of from one to 20 milliamperes per square centimeter.

14. The method of claim 1 in which the plating ion and cathode substrate are germanium.

* * * * *